US008721053B2

(12) United States Patent
Yasu et al.

(10) Patent No.: US 8,721,053 B2
(45) Date of Patent: May 13, 2014

(54) LIQUID DROPLET DISCHARGE HEAD AND IMAGE FORMING APPARATUS INCLUDING SAME

(75) Inventors: Kazuki Yasu, Kanagawa (JP); Shino Sasaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/544,149

(22) Filed: Jul. 9, 2012

(65) Prior Publication Data

US 2013/0016162 A1 Jan. 17, 2013

(30) Foreign Application Priority Data

Jul. 14, 2011 (JP) ..... 2011-155361

(51) Int. Cl.
*B41J 2/045* (2006.01)

(52) U.S. Cl.
USPC ..... 347/68; 347/10; 347/11

(58) Field of Classification Search
USPC ..... 347/68, 10, 11
See application file for complete search history.

(56) References Cited

U.S. PATENT DOCUMENTS 7,628,463 B2 12/2009 Sasaki
2008/0123117 A1* 5/2008 Kimura et al. ..... 358/1.8

FOREIGN PATENT DOCUMENTS

JP 2000-37867 2/2000
JP 2010-125740 6/2010

* cited by examiner

*Primary Examiner* — Henok Legesse
(74) *Attorney, Agent, or Firm* — Cooper & Dunham LLP

(57) ABSTRACT

A liquid droplet discharge head includes: a liquid chamber including an inner wall; a plurality of nozzles on a part of the inner wall; a diaphragm to change a pressure inside the liquid chamber; a piezoelectric element to displace the diaphragm; a drive voltage generator to generate a pulse voltage for normal driving; a micro-drive voltage generator to generate a pulse voltage for micro-driving; a voltage applying means to apply a voltage waveform including each pulse voltage to the piezoelectric element; and a nozzle activation ratio processor to calculate a nozzle activation ratio based on drive data for discharging liquid droplets from the nozzle. Based on the nozzle activation ratio, the micro-drive voltage generator generates a pulse voltage for the micro-driving including a peak voltage corresponding to the nozzle activation ratio, and the voltage applying means applies an appropriate voltage waveform to the piezoelectric element.

5 Claims, 9 Drawing Sheets

| ENVIRONMENT/DRIVE WAVEFORM | FIRST DRIVE WAVEFORM (NUMBER OF DROPLETS) | SECOND DRIVE WAVEFORM (NUMBER OF DROPLETS) |
|---|---|---|
| LL | 6 | 2 |
| MM | 4 | 1 |
| HL | 4 | 1 |

| ENVIRONMENT /DRIVE WAVEFORM | FIRST DRIVE WAVEFORM (NUMBER OF DROPLETS) | ... | EIGHTH DRIVE WAVEFORM (NUMBER OF DROPLETS) | NINTH DRIVE WAVEFORM (NUMBER OF DROPLETS) | TENTH DRIVE WAVEFORM (NUMBER OF DROPLETS) |
|---|---|---|---|---|---|
| LL | 6 | ... | 3 | 2 | 2 |
| MM | 4 | ... | 2 | 2 | 1 |
| HL | 4 | ... | 2 | 2 | 1 |

LIQUID DROPLET DISCHARGE HEAD AND IMAGE FORMING APPARATUS INCLUDING SAME

CROSS-REFERENCE TO RELATED APPLICATION

The present application claims priority from Japanese patent application number 2011-155361, filed on Jul. 14, 2011, the entire contents of which are incorporated by reference herein.

BACKGROUND OF THE INVENTION

1. Field of the Invention

The present invention relates to a liquid droplet discharge head and an image forming apparatus including the same.

2. Description of the Related Art

As an image forming apparatus such as a printer, a facsimile machine, a copier, a plotter, or a multifunction apparatus combining several of the capabilities of the above devices, for example, an inkjet recording apparatus is known which includes an ink droplet discharge head to discharge ink droplets and form images on a medium while conveying the medium by adhering the ink droplets to, for example, a sheet of paper or the like.

The inkjet recording apparatus includes nozzles to discharge ink droplets, a pressurized chamber communicating with the nozzles, an actuator to generate energy to increase the pressure inside the pressurized chamber, and a common liquid chamber communicating with the pressurized chamber and supply ink to the recording head. By activating the actuator, the pressure in the pressurized chamber is increased, thereby expelling ink droplets from the nozzles.

Inkjet recording apparatuses including a piezoelectric actuator are widely available, in which the actuator for discharging ink droplets is embodied as a piezoelectric actuator which vibrates in a direction perpendicular to an axial direction of a piezoelectric element. In such an inkjet recording apparatus using the piezoelectric actuator, drive pulse voltage generated by a drive voltage generator is applied to the piezoelectric elements fixed on a diaphragm which forms a part of an inner wall of the pressurized chamber, and the piezoelectric element vibrates. Due to the vibration of the piezoelectric element, the diaphragm displaces, thereby changing the inner pressure of the pressurized chamber. With this structure, the ink inside the pressurized chamber is discharged from nozzles as ink droplets as the ink is being supplied from the common liquid chamber to the pressurized chamber.

In the recording head of such an inkjet recording apparatus, because the ink is discharged from the nozzles onto a sheet to form an image, the ink is exposed to the atmosphere, which causes a solvent included in the ink to evaporate. As a result, agglomeration of the ink increases and the agglomerated ink tends to clog in nozzles, thereby causing defective ink discharge.

Japanese Patent No. 3611177 (JP-3611177-B) discloses a method of preventing defective discharge due to agglomerated ink inside the recording head. The disclosed method includes the following steps: (1) Based on the print data, operation status for each nozzle is analyzed before printing. Operation status includes data to show when and where each nozzle discharges ink droplets. (2) Pulse voltage being a constant peak voltage for micro-driving is applied to the piezoelectric element responsive to the analyzed operation status of each nozzle. The micro-driving means applying pressure of such a degree as not allowing the ink to be discharged from the nozzle by applying a pulse voltage for micro-driving with a peak voltage less than the peak voltage of the pulse voltage for normal driving, to the ink inside the recording head. The pulse voltage for the micro-driving is generated by voltage generator for the micro-driving. According to this, meniscus formed in the nozzle is slightly vibrated so that the viscous ink inside the recording head is agitated, thereby improving the viscosity degree of the viscous ink.

The method disclosed by Japanese Patent No. 3611177, however, has a disadvantage in that, due to repeated and long-time application of the pulse voltage to the piezoelectric element, the viscous ink diffuses inside the pressurized chamber and the volume of the liquid ink including the viscous ink is increased. As a result, the amount discharged by the dummy discharge for maintaining the discharging performance increases, resulting in unnecessary consumption of the liquid ink.

BRIEF SUMMARY OF THE INVENTION

The present invention provides an image forming apparatus capable of changing a peak voltage of the pulse voltage for the micro-driving to be applied to the piezoelectric element, thereby minimizing a volume of the viscous liquid ink and the dummy-discharged ink amount.

An optimal liquid droplet discharge head includes: a liquid chamber comprising an inner wall and to which a liquid is supplied; a plurality of nozzles disposed on a part of the inner wall; a diaphragm to change a pressure inside the liquid chamber, disposed on a part of the inner wall; a piezoelectric element to displace the diaphragm; a drive voltage generator to generate a pulse voltage for normal driving to cause the nozzles to discharge liquid droplets; a micro-drive voltage generator to generate a pulse voltage for micro-driving to vibrate a meniscus formed on the nozzle, the pulse voltage being smaller than the pulse voltage for normal driving and not so large as to cause discharge of liquid droplets from the nozzles; a voltage applying means to apply a voltage waveform including a pulse voltage for the normal driving and a pulse voltage for the micro-driving to the piezoelectric element; and a nozzle activation ratio processor to calculate a nozzle activation ratio of the nozzles based on drive data for discharging liquid droplets from the nozzle. In the liquid droplet discharge head, based on the nozzle activation ratio calculated by the nozzle activation ratio processor, the micro-drive voltage generator generates a pulse voltage for the micro-driving including a peak voltage corresponding to the nozzle activation ratio, and the voltage applying means applies the voltage waveform including the generated pulse voltage for the micro-driving and the generated pulse voltage for the normal driving to the piezoelectric element.

These and other objects, features, and advantages of the present invention will become more readily apparent upon consideration of the following description of the preferred embodiments of the present invention when taken in conjunction with the accompanying drawings.

DETAILED DESCRIPTION OF THE INVENTION

Hereinafter, preferred embodiments of the present invention will now be described with reference to the accompanying drawings.

In the present description, the media on which text or images are formed may be referred to as simply "sheet" but are not limited thereto, and include any recorded medium, transfer medium, recording sheet, and the like. The term "image forming apparatus" means an apparatus to perform image formation by impacting ink droplets to various media such as paper, thread, fiber, fabric, leather, metals, plastics, glass, wood, ceramics, and the like. "Image formation" means not only forming images with text or graphics having meaning but also forming images without intrinsic meaning such as patterns (and simply impacting the droplets to the medium). Similarly, the term "ink" is not limited thereto but is used as an inclusive term for every type of printable liquid, including DNA samples, registration and pattern materials, etc.

Figure 1A:
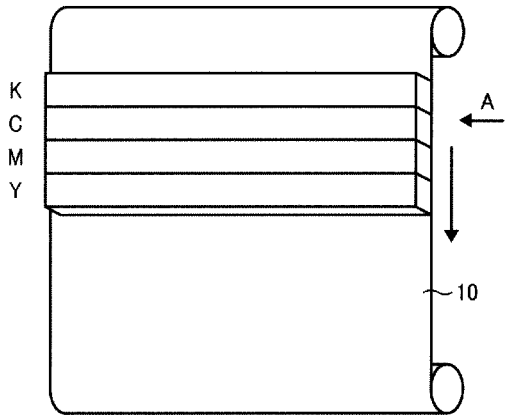
FIGS. 1A and 1B are schematic views of recording heads in a full-line type inkjet printer performing printing.
Figure 1B:
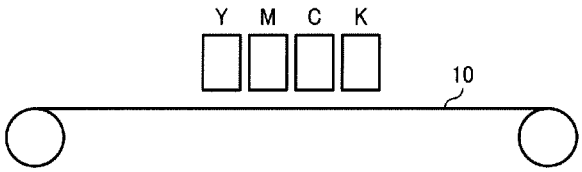

FIGS. 1A and 1B are schematic views of recording heads when a full-line type inkjet printer performs printing. FIG. 1A shows an oblique view and FIG. 1B shows a side view seen from A direction in FIG. 1A. In FIGS. 1A and 1B, each recording head Y, M, C, and K and a recorded medium 10 are opposedly disposed. The present invention may employ lengthy full-line type recording heads Y, M, C, and K as illustrated in FIG. 1A, and can employ a plurality of short heads Y, M, C, and K in combination. Accordingly, a case in which a full-line head is represented in one square shape is described; however, the full-line head is not only limited to a case using a single head but includes a case in which a full-line head unit is formed of a plurality of short heads.

Figure 2:
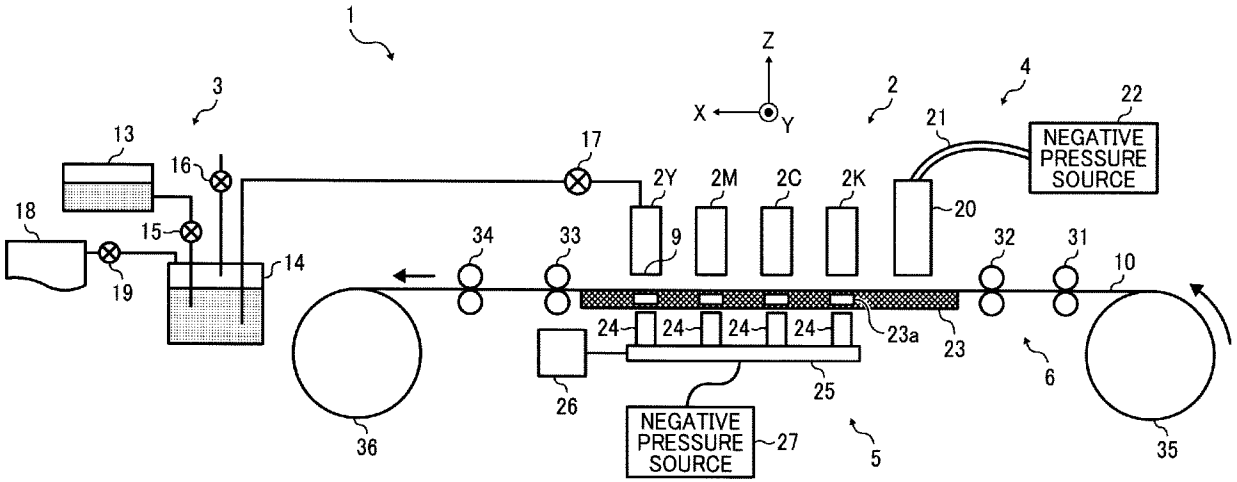
FIG. 2 is a schematic sectional view illustrating a structure of a full-line type inkjet printer.
Figure 3:
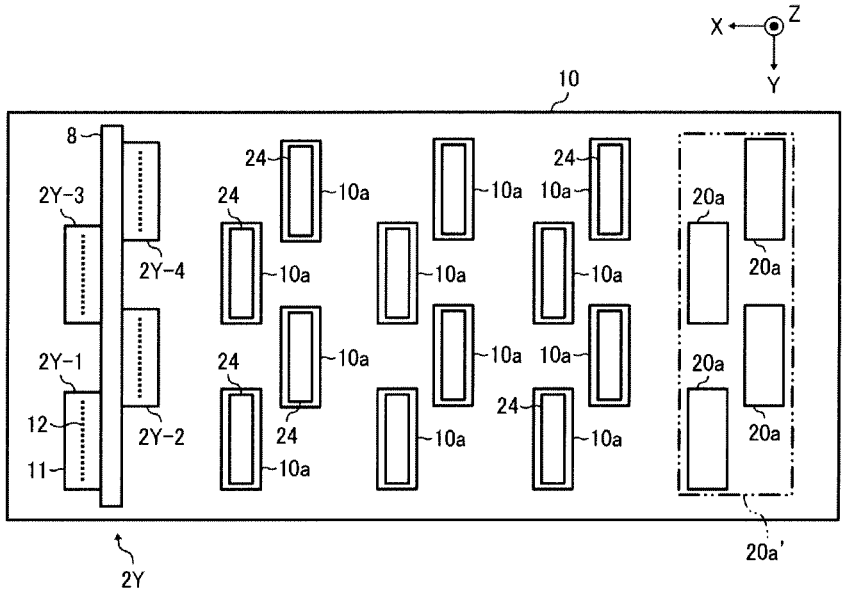
FIG. 3 is a plan view illustrating inkjet heads arranged in a staggered configuration.

FIG. 2 is a schematic view illustrating a structure of a full-line type inkjet printer. As illustrated in FIG. 2, an inkjet recording apparatus 1 includes an image forming unit 2, an ink supply unit 3, a punch unit 4, a maintenance unit 5, and a roll paper conveyance unit 6. The image forming unit 2 includes, from upstream to downstream in a recorded sheet conveyance direction, four recording heads, 2K, 2C, 2M, and 2Y, corresponding to ink colors black (K), cyan (C), magenta (M), and yellow (Y). For example, as illustrated in FIG. 3, the recording head 2Y for yellow (Y) includes four short inkjet heads, 2Y-1, 2Y-2, 2Y-3, and 2Y-4, disposed in a staggered configuration in a Y-axis direction and fixed on a holding plate 8. Each inkjet head 2Y-1, 2Y-2, 2Y-3, or 2Y-4 includes a row of nozzles 12 formed of multiple nozzles 11 each discharging ink to the recorded medium. The nozzle row 12 is formed on a nozzle plate 9 in a row. In addition, if seen from the X-axis direction, ends of the four inkjet heads 2Y-1, 2Y-2, 2Y-3, and 2Y-4 are slightly overlapped each other so as to form the recording head 2Y being one nozzle row having a length of recording width in the Y-axis direction. Other recording heads 2K, 2C, and 2M are similarly configured and disposed in the X-axis direction maintaining a same interval L. With this structure, the image forming unit 2 is formed of the linearly fixed recording heads that form an image with respect to the recording medium 10.

Next, the ink supply unit 3 includes an ink bottle 13, a sub tank 14, an ink supply electromagnetic valve 15, and the like. The ink bottle 13 is disposed at a highest position in the vertical direction. The ink supply electromagnetic valve 15 opens or closes, thereby appropriately supplying ink to the sub tank 14. The sub tank is provided with a liquid level detecting sensor, not shown, based on which the liquid ink level inside the sub tank 14 is controlled to be constant. The liquid level to be detected by the sensor is positioned at approximately 10 cm below the surface of the nozzle plate 9 of the inkjet heads from 2K-1, 2K-2, 2K-3, 2K-4, . . . , to 2Y-4 in the vertical direction.

The sub tank 14 is normally exposed to an external atmosphere by an electromagnetic purge valve 16. The sub tank 14 and each inkjet head 2K-1, 2K-2, 2K-3, 2K-4, and 2Y-4 is connected by ink flow passage. Further, a supply route valve 17 is disposed between the sub tank 14 and each inkjet head 2K-1, 2K-2, 2K-3, 2K-4, . . . , or 2Y-4. The ink supply unit 3 further includes a pressure pump 18 to send a compressed air to the sub tank 14. The pressure pump 18 is connected to the sub tank 14 and a pressure valve 19 is disposed between the pressure pump 18 and the sub tank 14. When liquid ink is supplied to each inkjet head from 2K-1, 2K-2, 2K-3, 2K-4, to 2Y-4, the ink supply electromagnetic valve 15, the electromagnetic purge valve 16, and the supply route valve 17 are fastened so that the pressure inside the sub tank 14 is increased, and thereafter, the supply route valve 17 is opened and the liquid ink is flushed to be supplied via the pressure pump 18. Structural parts including the ink bottle 13, the sub tank 14, the ink supply electromagnetic valve 15, the electromagnetic purge valve 16, the supply route valve 17, the pressure pump 18, and the pressure valve 19 are provided respectively for each color of black (K), cyan (C), magenta (M), and yellow (Y).

The punch unit 4 includes a punch 20, a tube 21, and a negative pressure source 22. The punch 20 is formed upstream of the conveyance direction of the recorded medium 10 of the image forming unit 2 and includes 4 rectangle-edged hollow blades 20*a* movable in the X-axis direction in the figure. The blades 20*a* are disposed in the Y-axis direction in a staggered manner similarly to the case of the recording heads 2K, 2C, 2M, and 2Y. An internal space of the punch 20 is connected to the negative pressure source 22 via the tube 21. In addition, the blades 20*a* include a moving device, not shown, so as to be movable in the X-axis direction.

Figure 4:
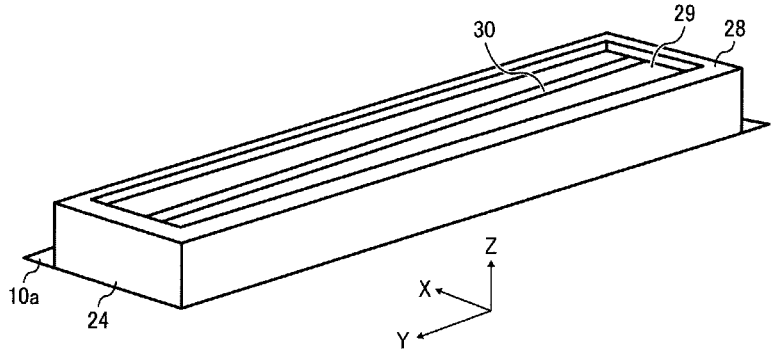
FIG. 4 is an oblique view illustrating a structure of a maintenance head.

The maintenance unit 5 is disposed at a space opposite the recording heads 2K, 2C, 2M, and 2Y and below the recorded medium 10 supported by a platen 23. The maintenance unit 5 includes maintenance heads 24; a support member 25 to support the maintenance heads 24, and a movable unit 26 to move the support member 25. The four sets of maintenance heads 24 are disposed in the staggered manner so as to correspond to the inkjet heads from 2K-1, 2K-2, 2K-3, 2K-4, . . . , to 2Y-4 in the Y-axis direction and another four sets in the X-axis direction. In addition, a negative pressure source 27 of a suction pump is connected to each maintenance head 24 via a tube formed inside the support member 25. A leading edge of the maintenance head 24 is so disposed as to oppose to a support opening 23*a* of the platen 23. As illustrated in FIG. 4, the leading edge of the maintenance head 24 includes a peripheral portion 28 contacting the nozzle plate 9, a recessed concave portion 29, and a suction hole 30 communicating with the negative pressure source 27 via the tube formed in the concave portion 29.

The planar platen 23 is so disposed as to oppose to the recording heads 2K, 2C, 2M, and 2Y. The platen 23 includes 4 sets of support openings 23*a* disposed in the staggered manner so as to correspond to the inkjet heads from 2K-1, 2K-2, 2K-3, 2K-4, . . . , to 2Y-4 and the maintenance heads 24 in the Y-axis direction and another four sets in the X-axis direction.

The roll paper conveyance unit 6 includes conveyance rollers 31 to 34, an original roller 35, and a wind-up roller 36. The recorded medium 10 is continuous paper wound over the original roller 35 in a roll shape, is pulled up from the original roller 35 via the conveyance rollers 31, 32, 33, and 34, is conveyed on the platen 23 and wound up by the wind-up roller 32.

Next, image formation in the thus-configured inkjet recording apparatus 1 will now be described.

First, the conveyance rollers 31, 32, 33, and 34 are driven so that the recorded medium 10 is pulled out from the original roller 35 and is conveyed on the platen 23 toward the image forming unit 2 in which four recording heads 2K, 2C, 2M, and 2Y are disposed. At this time, image data is supplied to the recording head 2 to cause each of the four recording heads 2K, 2C, 2M and 2Y to discharge ink droplets corresponding to the colors black (K), cyan (C), magenta (M), and yellow (Y), respectively, so that an image is formed on the recorded medium 10. Thereafter, the recorded medium 10 is wound up by the wind-up roller 36. During image formation, the ink supply unit 3 configured as described above supplies ink to the recording heads 2K, 2C, 2M, and 2Y. At this time, the peripheral portion 28 of the maintenance head 24 is positioned below the surface of the platen 23 supporting the recorded medium 10 as indicated by a solid line in FIG. 5 so that the maintenance head 24 does not interfere with the recorded medium 10. The support opening 23*a* is formed in the platen 23.

Figure 5:
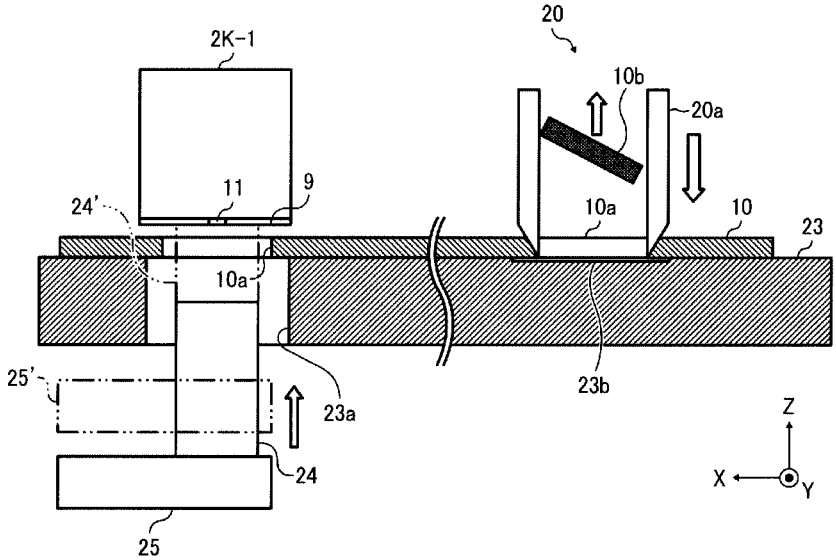
FIG. 5 is a cross-sectional view illustrating the structure of the maintenance head in operation.

Maintenance is performed as follows. First, the conveyance of the recorded medium 10 is interrupted and opening operation to the recorded medium 10 is performed by the punch unit 4. Specifically, the negative pressure source 22 is driven to generate a negative pressure. Then, as illustrated in FIG. 5, the blade 20*a* is pushed against the platen 23 by the moving unit, not shown, and the recorded medium 10 is punched in a square shape so that the medium opening 10*a* is formed. A punched part 10*b* is sucked by the negative pressure source 22 via the tube 21 due to the negative pressure. A part 23*b* of the platen 23 against which the blade 20*a* is pressed has a recessed portion 0.1 to 0.5 mm deep as illustrated in FIG. 5 and does not contact the recorded medium 10 even though the surface flatness of the platen surface is degraded by the blade 20*a*, and therefore, does not affect the sheet conveyance performance. Due to the above punching process, four medium openings 10*a* disposed in a staggered manner in the Y-axis direction are generated. Thereafter, the recorded medium 10 is moved in the conveyance direction by the interval L between adjacent recording heads 2K, 2C, 2M, and 2Y, and the punching process is continued. Then, the same process is repeated three times so that four rows of medium openings 10*a* are formed in the X-axis direction. Then, the recorded medium 10 is conveyed by a distance between the blade 20*a* and the recording head 2K, and each medium opening 10*a* is caused to be positioned directly below the nozzle plate 9 of each inkjet head 2K-1, 2K-2, 2K-3, 2K-4, . . . , and 2Y-4.

Next, the movable unit 26 moves the maintenance head 24 and the support member 25 toward the (+)X-axis direction so that the peripheral portion 28 of the leading edge of each maintenance head 24 is contacted against the surface of the nozzle plate 9 of the inkjet head 2K-1, 2K-2, 2K-3, 2K-4, . . . , and 2Y-4. At this time, the maintenance head 24 is positioned at a position 24' as indicated by a broken line in FIG. 5 and the support member 25 is positioned at a position 25' as illustrated in FIG. 5 by the same broken line. The support opening 23*a* is formed in the platen 23.

After the maintenance head 24 corresponding to each inkjet head 2K-1, 2K-2, 2K-3, 2K-4, . . . , and 2Y-4 is closely attached to the nozzle plate 9, the maintenance process is performed.

Specific steps of the maintenance process will now be described.

[Capping Process] A capping process is performed when image forming operation is not performed for a long period of time or when the power to the image forming apparatus I is turned off. First, as described above, the maintenance head 24 and the support member 25 are moved in the (+)Z-axis direction by the moving movable unit 26, and the peripheral portion 2 of the leading edge of each maintenance head 24 is contacted to the surface of the nozzle plate 9 of each inkjet head 2K-1, 2K-2, 2K-3, 2K-4, . . . , and 2Y-4. At least the peripheral portion 28 of the maintenance head 24 (see FIG. 4) is formed of an elastic material such as fluorine rubber, and the peripheral portion 28 closely attaches to the nozzle plate 9.

Due to this capping process, while the inkjet recording apparatus 1 is not being used, all nozzles 11 are positioned inside the concave portion 29, and the ink inside the nozzles 11 is prevented from agglomerating and drying, and further, the adhesion of dust particles around the nozzles 11 can be prevented.

[Dummy discharging process] In the dummy discharging process, while the negative pressure source 27 is being activated, voltage is applied to an electrode inside each inkjet head 2K-1, 2K-2, 2K-3, 2K-4, . . . , and 2Y-4, so that the ink is discharged to the concave portion 29 from each nozzle 11. By the dummy discharging process, viscous ink around each nozzle 11 and foreign particles are removed from the nozzles to thus recover the discharging performance. In addition, the ink discharged to the concave portion 29 is sucked from the suction hole 30 by the negative pressure source 27 via the tube formed inside the support member 25 and is reserved in a waste liquid tank, not shown.

Concerning the dummy discharging process, the image forming apparatus not only performs the above dummy discharge by interrupting the sheet conveyance, but performs the dummy discharge while the sheet is being conveyed and printing is being performed. In the dummy discharge during printing, the recording head cannot be moved, and, because the continuous paper is used as a recorded medium, the sheet is continuously conveyed. Therefore, the ink and the like are discharged on the sheet. The dummy discharging during printing includes a line flushing method and a star flushing method. In the line flushing method, a line is formed at a boundary between a sheet and a next sheet of the to-be-recorded image. In the star flushing method, fine droplets not affecting the image are discharged dispersedly over an entire image to be recorded.

[Pressure Purge Process] In the pressure purge process, the ink supply electromagnetic valve 15, the electromagnetic purge valve 16, and the supply route valve 17 are closed, the pressure valve 19 is opened, and the pressure pump 18 is driven to cause an interior of the sub tank 14 to have a predetermined pressure. Thereafter, the supply route valve 17 is opened to apply pressure to an interior of the ink chamber, not shown, in the inkjet head 2K-1, 2K-2, 2K-3, 2K-4, . . . , to 2Y-4 via the ink flow passage, thereby pushing out the ink from the nozzles 11. The pushed-out ink by this process is sucked via the suction hole 30. With this maintenance process, viscous ink around each nozzle 11 and foreign particles are removed from the nozzles and the discharging performance can be recovered.

[Suction Purge Process] In the suction purge process, the negative pressure source 27 is activated to generate a negative pressure inside the concave portion 29 so that the ink inside the nozzles 11 or the ink remaining on the surface of the nozzle plate 9 is sucked. With this maintenance process, viscous ink around each nozzle 11 and foreign particles are removed from the nozzles 11, and unnecessary ink on the surface of the nozzle plate is removed, so that the discharging performance can be recovered. Further, in the dummy discharging process, the pressure purge process, and the suction purge process, it can be configured that the negative pressure level of the negative pressure source 27 can be changed.

When the image formation is performed after any of the maintenance processes, the maintenance head 24 and the support member 25 are moved in the (−)Z-axial direction, the recorded medium 10 is conveyed, and all medium openings 10*a* are moved toward downstream of the image forming unit 2. Thereafter, the image formation is to be started. In post-processing such as cutting of the recorded medium 10 wound by the wind-up roller 36, post-processing operations are performed by detecting a mark simultaneously printed on the target image. If necessary, marks indicating a first position and a last position on which the medium opening 10*a* is formed are detected, or alternatively, the medium opening 10*a* is directly detected by an optical sensor or the like, and the part on which this medium opening 10*a* is formed can be treated in post-processing separately from the part on which the printing-target image is formed.

With such a configuration, the maintenance of the recording heads 2K, 2C, 2M, and 2Y using the continuous sheet can be performed with the continuous sheet loaded on the image forming unit 2. Therefore, time to start the image forming process after maintenance can be minimized and throughput can be improved.

Because the continuous sheet need not be cut during maintenance operation, winding up of the sheet can be performed to a continuous roll, thereby making post-processing after image formation easier. Further, during printing of one roll, even though the printing operation is interrupted for a long period of time, the above-described capping process can be performed, thereby making the handling easier. Further, because the maintenance unit 5 is disposed opposite the recording heads 2K, 2C, 2M, and 2Y with the recorded medium 10 in between, it is enough to slightly move the maintenance head 24 and the support member 25 in the Z-axis direction. Accordingly, the movable unit can be downsized and the inkjet recording apparatus can also be formed in a compact shape.

For example, a minimum displacement amount of the maintenance head 24 can be approximately 0.5 to 3.0 mm, which is the size of an interval between the recording heads 2K, 2C, 2M, and 2Y and the surface of the platen 23 supporting the recording medium 10. In addition, because there is no need to move the recording heads 2K, 2C, 2M, and 2Y for the maintenance, precise positioning of the recording heads 2K, 2C, 2M, and 2Y can be maintained and high-quality images can be created.

Figure 6:
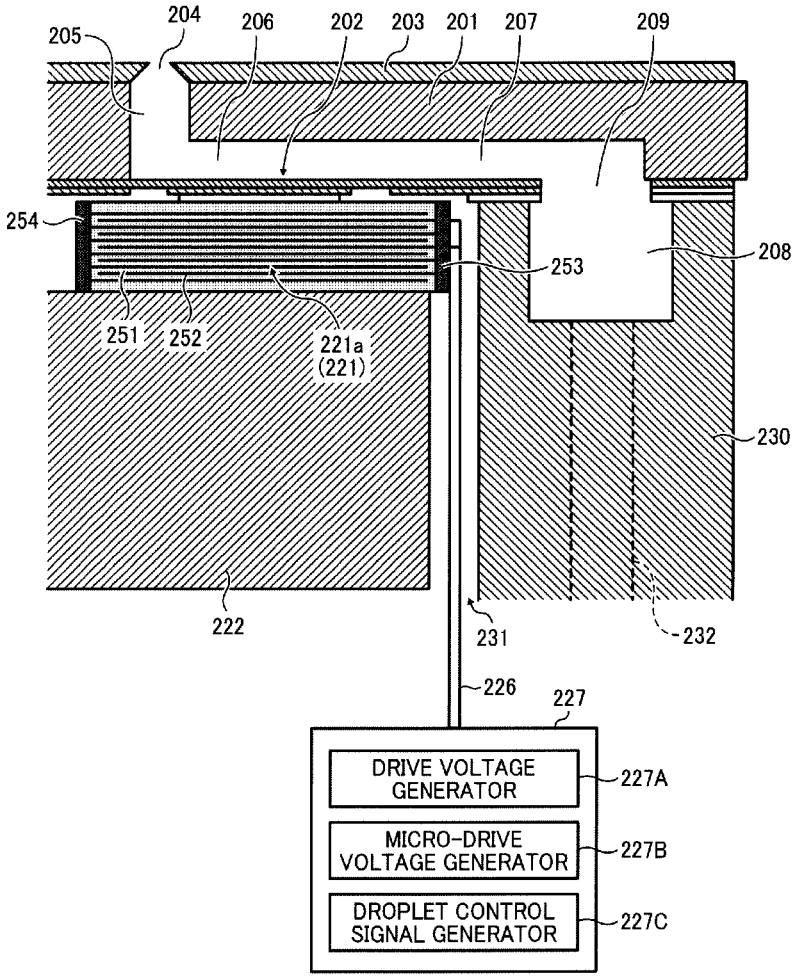
FIG. 6 is a cross-sectional view along a longitudinal direction of a liquid chamber of a liquid droplet discharge head.
Figure 7:
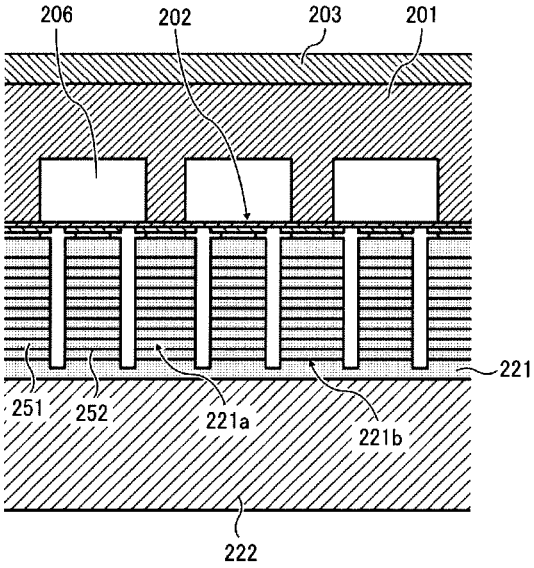
FIG. 7 is a cross-sectional view along a shorter-side direction of the liquid chamber of the liquid droplet discharge head.

Next, an example of the ink droplet discharge head forming the recording head in the image forming apparatus will now be described with reference to FIGS. 6 and 7. FIG. 6 is a cross-sectional view along a longer side direction of the liquid chamber of the liquid droplet discharge head. FIG. 7 is a cross-sectional view along a shorter side direction of the liquid chamber of the liquid droplet discharge head (or nozzle arrangement direction).

The liquid droplet discharge head includes a flow passage plate 201, a diaphragm 202, and a nozzle plate 203, which are laminated one on top of the other. The flow passage plate 201 is formed by anisotropic etching of a monocrystal silicon substrate. The diaphragm 202 is laminated below the flow passage plate 201 and is formed of electroplated nickel, for example. The nozzle plate 203 is laminated on an upper surface of the flow passage plate 201. With such a configuration, a nozzle through-hole 205, which is a flow passage of a nozzle 204 discharging liquid droplet (or ink droplet), a liquid chamber 206, a common liquid chamber 208 to supply ink to the liquid chamber 206, and an ink supply port 209 communicating with the common liquid chamber 208 are formed.

Further, the liquid droplet discharge head includes two rows of lamination-type piezoelectric elements 221 and a base substrate 222 on which the piezoelectric elements 221 are laminated and fixed. For simplicity, FIG. 6 illustrates only one row of piezoelectric elements 221. The piezoelectric elements 221 serve as an electro-mechanical transducer and a pressure generator, and deform the diaphragm 202 and generate pressure to be applied to the ink inside the liquid chamber 206. A support pillar 223 is provided between the piezoelectric elements 221. The support pillar 223 is formed as an integral part of the piezoelectric elements 221 by dividing the piezoelectric element material, but is used as a support pillar only because a drive voltage is not applied to the support pillar 223.

Further, each piezoelectric element 221 is connected to an FPC cable 226, which is connected to a drive circuit 227. The drive circuit 227 includes a drive voltage generator 227A configured to generate drive voltage waveforms, a micro-drive voltage generator 227E configured to generate waveforms of a first micro-drive voltage and waveforms of a second micro-drive voltage, and a droplet control signal generator 227C to generate drive control signals. A peripheral part of the diaphragm 202 is connected to a frame member 230. The frame member 230 includes a through-hole portion 231 containing an actuator unit which includes the piezoelectric elements 221 and the base substrate 222; a concave portion used as the common liquid chamber 208; and an ink supplying hole 232 configured to supply liquid ink to the common liquid chamber 208 from outside. The frame member 230 is formed using thermally curable resins such as epoxy resins or polyphenylene sulfide, which is subjected to injection molding.

Here, the flow passage plate 201 is formed such that the monocrystalline silicon substrate having crystal face orientation (110) is subjected to anisotropic etching using alkali etching aqueous fluid such as potassium hydroxide aqueous solution (KOH), to thus form a nozzle through-hole passage 205 and a concave and hollow portion for the liquid chamber 206. It is to be noted that the material is not limited to the monocrystalline silicon substrate and other stainless substrates or photosensitive resins can be used.

The diaphragm 202 is formed from nickel plate by way of, for example, electroplating. Alternatively, the diaphragm 202 can be formed from other metal plates or a member combining metal and resin. Further, the piezoelectric element 221 and the support pillar 223 are bonded to the diaphragm 202 with an adhesive, and further the frame member 230 is bonded to the diaphragm 202. The nozzle plate 203 forms a nozzle 204 with a diameter of from 10 to 30 μm corresponding to each liquid chamber 206, and is bonded to the flow passage plate 201 with an adhesive. The nozzle plate 203 includes a nozzle forming member formed of a metal material and an uppermost layer formed of water-repellent material. Between the nozzle forming member and the uppermost layer there is another layer.

The piezoelectric element 221 has a layered structure (formed of piezoelectric zirconate titanate or PZT) in which piezoelectric material 251 and an internal electrode 252 are alternately laminated. An individual electrode 253 and a common electrode 254 are connected to each internal electrode 252 drawn to an alternately different edge surface of the piezoelectric element 221. In this embodiment, a structure to pressurize ink inside the liquid chamber 206 is employed using displacement in a d33 direction as a piezoelectric direction of the piezoelectric element 221. However, a structure to pressurize ink inside the liquid chamber 206 using displacement in a d31 direction as a piezoelectric direction of the piezoelectric element 221*a* can be taken. It is also possible to provide one row of piezoelectric elements 221 on one substrate 222.

In the thus-configured liquid droplet discharge head, if for example the voltage to be applied to the piezoelectric element 221 is lowered from the reference potential, the piezoelectric element 221 is contracted, the diaphragm 202 is lowered, and a volume of the liquid chamber 206 is expanded. Thus, the ink flows into the liquid chamber 206. When the voltage to be applied to the piezoelectric element 221 is increased, the piezoelectric element 221 is extended in the layered direction, the diaphragm 202 is deformed toward the nozzle 204, and the volume of the liquid chamber 206 is contracted. Thus, the liquid ink inside the liquid chamber 206 is compressed and the recording liquid droplet is discharged from the nozzle 204.

When the voltage applied to the piezoelectric element 221 is returned to the reference potential, the diaphragm 202 returns to an initial position and the liquid chamber 206 is expanded to generate a negative pressure. At this time, the recording liquid is filled in the liquid chamber 206 from the common liquid chamber 208. Then, after vibration of the meniscus surface of the nozzle 204 is damped and stabilized, the operation proceeds to a next liquid droplet discharging.

The head driving method is not limited to the methods as described above (i.e., pressure purge and suction purge) but the liquid droplet discharging may be performed by changing the drive waveform.

Next, a first embodiment of an image forming apparatus according to the present invention will now be described with reference to FIGS. 8 and 9.

The image forming apparatus according to the first embodiment forms an image in such a manner that the conveyance rollers 31, 32, 33, and 34 are driven to pull out the recorded medium 10 from the original roller 35 as illustrated in FIG. 2 and four recording heads 2K, 2C, 2M, and 2Y are caused to discharge ink droplets, on the recorded medium 10, corresponding to black (K), cyan (C), magenta (M), and yellow (Y), respectively, in accordance with the input image data. The to-be-recorded image data is analyzed before printing, and a ratio of the ink discharge signal among all input signals and a nozzle activation ratio are calculated before printing the image. Specifically, among all pixel number (or a total effective number of ink droplets) in an effective image forming area, an actual pixel number (or an actual number of ink droplets) is calculated based on the to-be-recorded image data, and the ratio of the calculated number to the total pixel number is set as the nozzle activation ratio. As a result of calculation of the nozzle activation ratio, if the image data is one in which the nozzle activation ratio exceeds a threshold value, the first drive waveform is used for the micro-drive voltage and printing is performed. On the other hand, if the image data is one in which the nozzle activation ratio is lower than the threshold value, the second drive waveform is used for the micro-drive voltage and printing is performed. In the first drive waveform, the micro-drive voltage is set to the current value. In the second drive waveform, the micro-drive voltage is set to lower than the existing value.

Figure 8:
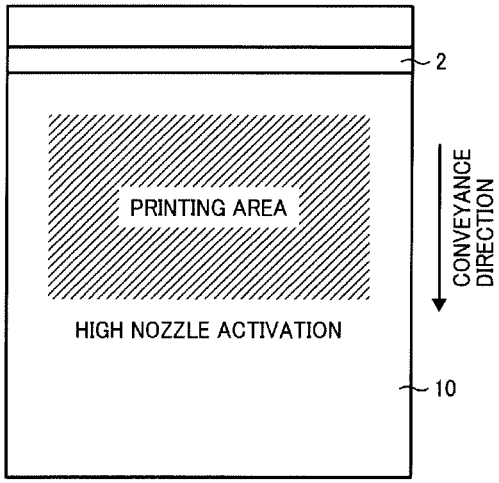
FIG. 8 is an explanatory plan view in a case of high nozzle activation according to a first embodiment of the present invention.

For example, as illustrated in FIG. 8, when the image data corresponds to a large printing area, that is, the nozzle activation ratio is high, the existing drive waveform is used. By contrast, as illustrated in FIG. 9, when the image data corresponds to a small printing area, that is, the nozzle activation ratio is low, the drive waveform having a peak voltage of the pulse voltage for the micro-drive that is smaller than the existing drive voltage is used. In addition, the dummy discharge is in particular performed by line flushing, in which printing is performed to a boundary of a sheet with a specific size, for example, a boundary of the A-4 sheet. The dummy-discharged line is later cut off.

Thus, by setting the peak voltage of the pulse voltage for the micro-driving to lower than the threshold value, the volume of the viscous ink around the nozzle can be minimized. Further, the discharging stability of the nozzle can be maintained with a smaller dummy discharging amount, and an adverse effect of the line flushing of the wasted sheet can be minimized.

Specifically, in the present embodiment, when the nozzle activation ratio of the to-be-recorded image data is more than 30%, the first drive waveform is selected. When the nozzle activation ratio is less than 30%, the second drive waveform is selected. FIG. 10 is a chart showing a number of droplets in each environmental condition of the first drive waveform and the second drive waveform. From the chart, it is understood that the number of droplets in the dummy discharging can be reduced. If the second drive waveform is selected, it can be read that the largeness of the ink droplet is reduced compared to a case in which the first drive waveform is selected. However, because the nozzle activation ratio is less than 30% and therefore the ink coverage area is small, the adverse effect may be small. Environmental conditions in FIG. 10 are as follows. LL means low temperature and low humidity, MM means medium or room temperature and humidity, and HL means high temperature and low humidity. FIG. 10 shows the number of dummy-discharged droplets for each drive waveform in each of the environmental conditions.

Next, a second embodiment according to the present image forming apparatus will now be described.

In the first embodiment, two types of drive waveforms are available according to the nozzle activation ratio. In the second embodiment, the types are further divided into N-types (N is a positive integer). In this case, the first drive waveform is set to an existing micro-drive waveform V1 and the micro-drive value V2 of the second drive waveform is set to satisfy V1>V2. A micro-drive value VN of the N-th drive waveform is so set as to satisfy the following inequation: V(N−1) >VN>V(N+1)>. . . >VL, wherein N is a positive integer equal to or larger than 2, and VL is a minimum micro-drive value capable of preventing defective discharging before performing a dummy discharge and maintaining stability in discharging droplets.

Further, the selection of each drive waveform is performed first by setting N-number of P1, P2, . . . , PN (wherein 100%>P1>P2>. . . >PN), and next by calculating the nozzle activation ratio P as in the case of the first embodiment, and selecting the i-th drive waveform when a formula Pi−1>P>Pi (P0=100%) is satisfied.

Thus, by setting the micro-drive voltage lower than the existing value for the recorded image data with the nozzle activation ratio P<P1, the volume of the viscous ink around the nozzle can be minimized. Further, the discharging stability of the nozzle can be maintained with a less dummy discharging amount, and an adverse effect of the line flushing to the wasted sheet can be minimized.

Specifically, it is preferably set to N=10 and P i=30−3*i. FIG. 11 shows numbers of droplets in each environmental condition of the i-th drive waveform. The micro-drive waveform can be set based on the correlation between the nozzle activation ratio and the dummy-discharged number of droplets. It is understood that the number of droplets in the dummy discharging can be reduced particularly when the nozzle activation ratio is below P1. If the i-th drive waveform (i>1) is selected, it can be guessed that the size of the ink droplets is reduced compared to a case in which the first drive waveform is selected. However, because the nozzle activation ratio is less than 30% and therefore the ink coverage area is small, the adverse effect may be small.

Next, a third embodiment according to the present image forming apparatus will now be described.

In the first embodiment, two types of drive waveforms are available according to the nozzle activation ratio. In the third embodiment, the drive waveforms can be divided based on whether the recorded image data includes any data other than text, such as photographic data. In this case, the recorded image data is analyzed and the first drive waveform is selected in a case including the image data other than characters and the second drive waveform is selected in a case including text data only. Thus, by setting the micro-drive voltage lower than the existing value for the recorded image data including only characters, the volume of the viscous ink around the nozzle can be minimized, the stability of the nozzles in discharging droplets can be maintained with a less dummy discharge amount, and an adverse effect of the line flushing can be minimized.

Figures 9, 10, 11:
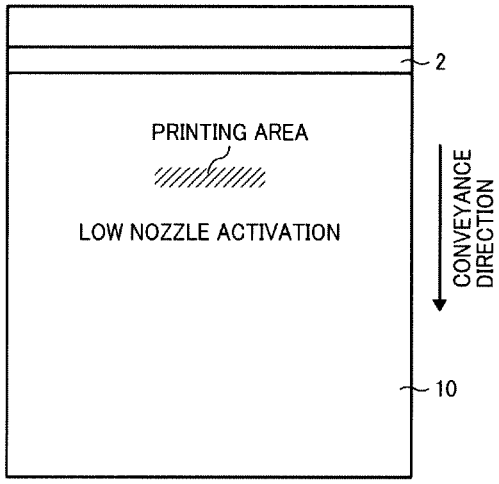
FIG. 9 is an explanatory plan view in a case of low nozzle activation according to a first embodiment of the present invention.
FIG. 10 is a chart showing a number of droplets in each of multiple different environmental conditions of a first drive waveform and a second drive waveform.
FIG. 11 is a chart showing a number of droplets in each of multiple different environmental conditions of first to tenth drive waveforms.

The number of dummy-discharged droplets in each environmental condition of the first drive waveform and the second drive waveform is shown in FIG. 10. It can be understood that the number of droplets in the dummy discharging can be reduced when the to-be-recorded image data includes text data only. If the second drive waveform is selected, it can be deduced that a size of the ink droplet is reduced compared to a case in which the first drive waveform is selected. However, because the data includes text data only and therefore the ink coverage area is small, an adverse effect to the image quality due to the reduction in the diameter of the ink droplet may be small.

Next, an example of a configuration to control the first and second drive waveforms with the nozzle activation ratio of the first embodiment will now be described with reference to FIGS. 12 and 13.

Figure 12:
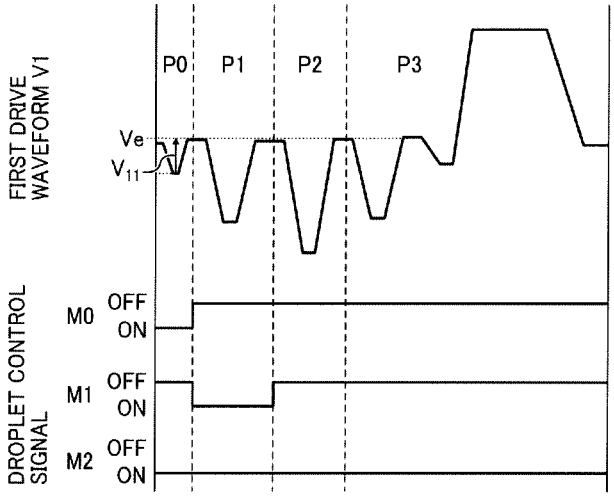
FIG. 12 shows a first drive waveform and signal waveforms of droplet control signals.
Figure 13:
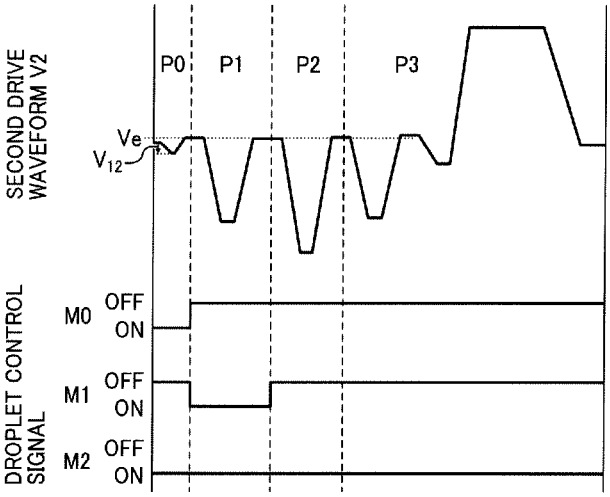
FIG. 13 shows a second drive waveform and signal waveforms of droplet control signals.

The two drive waveforms as described above are the first drive waveform V1 including a drive pulse or signal enabling a micro-drive by a conventional voltage as illustrated in FIG. 12 and the second drive waveform V2 including a drive pulse or signal enabling a micro-drive less than the conventional voltage as illustrated in FIG. 13. To be more specific, as illustrated in FIG. 12 (or FIG. 13), each of the first and second drive waveforms includes a non-discharge drive signal P0 slightly driving the nozzle meniscus so as not to discharge any liquid droplet, and a plurality of the first discharge drive signals or pulses P1 to P3 enabling discharge of ink droplets of the discharge amount to be used for image formation. Herein, each of the drive signals P0 to P3 is formed of a waveform element falling from a reference potential Ve and a waveform element. The waveform element of the drive signal falling from the reference potential Ve is a pulling in waveform element by which the piezoelectric element 221 in FIGS. 6 and 7 is contracted and the volume of the pressurized chamber 206 is expanded. The waveform element rising is a pressurizing waveform element by which the piezoelectric element 221 is expanded and the volume of the pressurized chamber 206 is contracted. Specifically, herein, the drive signal P0 included in the drive waveform is a micro-drive signal to apply a meniscus vibration without discharging any liquid droplet. The peak voltage V11 of the drive signal P0 is set to a conventional value in the first drive waveform as illustrated in FIG. 12 and the peak voltage V12 of the drive signal P0 in the second drive waveform is set to a value less than the peak voltage V11 as illustrated in FIG. 13. Herein, the smaller peak voltage means that the difference from the reference potential Ve is small, and that the fallen voltage amount from the reference potential Ve of the drive pulse P0 is small particularly in the micro-drive voltage.

The drive signals P1 to P3 are drive waveforms to cause the liquid discharging heads 2K-1, 2K-2, 2K-3, 2K-4, . . . , 2Y-4 to discharge liquid droplets by expanding the liquid chamber 206 communicating with the nozzle 204 and then contracting the liquid chamber 206. Because droplet control signals M0 to M3 as illustrated in FIGS. 12 and 13 are sent from a data transfer unit, the droplet control signal M0 selects the drive signal P0 by turning the M0 to ON when a micro-drive is performed, the droplet control signal M1 selects the drive signal P1 only by turning the M1 to ON when a small droplet (or a small dot) is to be formed, and the droplet control signal M2 selects all the drive signals P0 to P3 by turning the M2 to ON when a large droplet (or a large dot) is to be formed, thereby applying drive signals P0 to P3 to the piezoelectric element 221 of the recording head. Herein, the size of the droplets includes two types, a small droplet and a large droplet. However, a medium-sized droplet intermediate in size between the two can be discharged.

In addition, in the case of the dummy discharge, for example, the waveforms having the same waveform as that of the drive waveform are discharged and the signal for the large droplet is used. Moreover, the difference between the first drive waveform V1 and the second drive waveform V2 resides in a difference of the wave height (or the amplitude) in the slight voltage signal P0.

Then, the nozzle activation ratio is calculated based on the to-be-recorded image data as to each nozzle 204 of each head 2K-I, 2K-2, 2K-3, 2K-4, . . . , 2K-4 of the recording head 2, the first drive waveform V1 and the second drive waveform V2 are selectively switched, and when the nozzle activation ratio is more than the threshold value, the first drive waveform V1 is applied, and, when the nozzle activation ratio is less than the threshold value, the second drive waveform V2 is applied to the piezoelectric element 221.

Next, a relation between the amount of the micro-drive voltage and the dummy discharging amount will be described.

Figure 14:
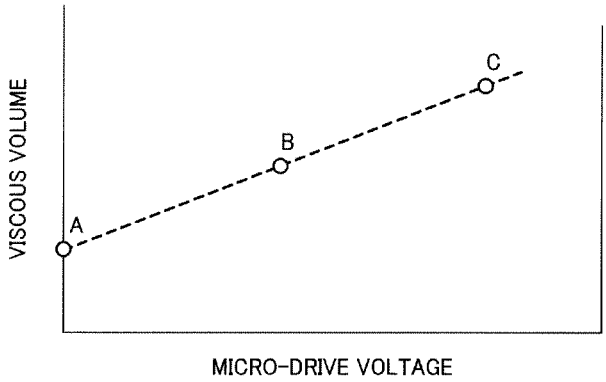
FIG. 14 shows a curve illustrating a relation between a micro-drive voltage and a viscous volume.
Figure 15:
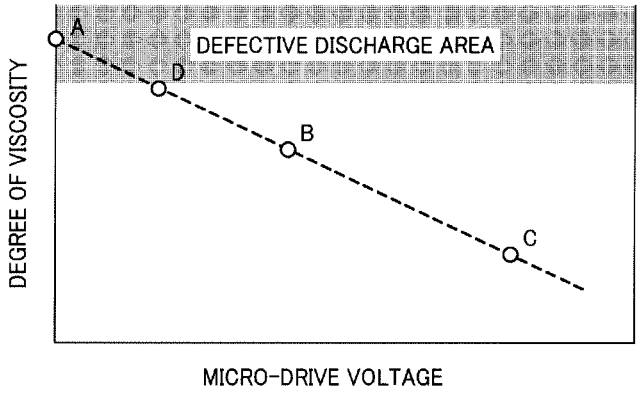
FIG. 15 shows a curve illustrating a relation between a micro-drive voltage and a degree of viscosity.

FIG. 14 shows a relation between a micro-drive voltage and a volume of the viscous ink from the nozzle in the dummy discharge. FIG. 14 shows a case of the dummy discharge at a boundary of the A-4 sheet. Because the viscous ink is agitated by the micro-drive, the greater the micro-drive voltage, the larger the volume of the viscous ink. In addition, in order to prevent occurrence of the defective discharge due to accumulation of the viscous ink, the agglomerated ink should all be discharged by the dummy discharge. Accordingly, as the micro-drive becomes larger, the concomitant dummy-discharged amount becomes greater. FIG. 15 shows a relation between the micro-drive voltage and the degree of viscosity of the agglomerated ink in the dummy discharge. FIG. 15 shows a case in which, for example, the dummy discharge is performed at a boundary of the A-4 sheet. The liquid ink can be discharged without any problem when the viscosity of the ink is low. However, when the viscosity is over a threshold level, a defective discharge occurs. A point C in FIG. 15 shows a conventional micro-drive voltage. At a point A in which the micro-drive is too small, a defective discharge occurs before performing the dummy discharge. Accordingly, even though the dummy discharge amount becomes small as illustrated in FIG. 4, the micro-drive at the point A can not be selected. Accordingly, if the micro-drive voltage corresponding to a point B is selected, the dummy discharge amount can be reduced and a normal discharge obtained. Then, the micro-drive voltage at the point B is selectable for the second drive waveform. With such a selection, the dummy discharge amount can be reduced when using the second drive waveform. The micro-drive voltage corresponding to a point D at which defective discharge occurs in the dummy discharging is the minimum micro-drive voltage VL as described in the second embodiment.

In each of the embodiments, a full-line type inkjet printer is used; however, even a line-type inkjet printer using a plurality of recording heads or a serial-type printer in which the recording head scans in the main scanning direction may select any drive waveform with a different micro-drive voltage based on the to-be-recorded image data and can reduce the dummy discharge amount.

The aforementioned embodiments are examples and specific effects can be obtained for each of the following aspects of (A) to (D):

(Aspect A) A nozzle activation ratio processor is caused to calculate the nozzle activation ratio based on the drive data to discharge liquid droplets from the nozzle. The peak voltage of the pulse voltage for micro-driving generated by the micro-drive voltage generator is changed based on the nozzle activation ratio calculated by the nozzle activation ratio processor, and the voltage waveform including the pulse voltage for the micro-drive is applied to the piezoelectric element. According to this operation, as described in the first and second embodiments, when the micro-drive voltage is reduced, diffusion of the viscous ink inside the pressurized chamber can be minimized. Thus, when the nozzle activation ratio is particularly low and the image quality is not preferred, the waste amount of the liquid ink by the dummy discharge can be reduced.

(Aspect B) When the nozzle activation ratio calculated by the nozzle activation ratio processor exceeds a threshold value in the above aspect A, the voltage waveform including the pulse voltage for the first micro-driving generated by the micro-drive voltage generator is applied to the piezoelectric element and the first micro-driving is performed. When the nozzle activation ratio calculated by the nozzle activation ratio processor is lower than the threshold value, the voltage waveform including the pulse voltage for the first micro-driving less than the peak voltage value of the pulse voltage for the first micro-driving generated by the micro-drive voltage generator is applied to the piezoelectric element and the second micro-driving is performed. According to this operation, as described in the first embodiment, when the nozzle activation ratio is less than the threshold value, the amount of the micro-driving is lessened, diffusion of the viscous ink inside the pressurized chamber is minimized, and the increase of the volume of the viscous liquid ink can be minimized. With this configuration, the amount of the wasted liquid ink by the dummy discharge can be reduced.

(Aspect C) When the liquid is a recording liquid and an image is formed on the recorded medium by discharging the recording liquid from the nozzle, and the data includes any data other than characters, the first micro-driving is performed. When the data includes only characters, the second micro-driving is performed. As described in the third embodiment, when the data includes any data other than characters, the desired image quality is high. In this case, the first micro-driving is performed. When the data includes only characters, the desired image quality is not preferred. In this case, the second micro-driving is performed. With this configuration, the amount of the wasted liquid ink by the dummy discharge can be reduced.

(Aspect D) The inkjet printer including a liquid droplet discharge head in Aspect A to C forms an image by discharging a recording liquid from the nozzle to the recorded medium. With this configuration, the amount of the dummy-discharged liquid ink can be reduced in accordance with the desired image quality when in particular the image quality is not preferred.

Additional modifications and variations of the present invention are possible in light of the above teachings. It is therefore to be understood that, within the scope of the appended claims, the invention may be practiced other than as specifically described herein.

What is claimed is:

1. A liquid droplet discharge head comprising:

a liquid chamber to which a liquid is supplied;

a plurality of nozzles from which the liquid is discharged;

a diaphragm to change a pressure inside the liquid chamber;

a piezoelectric element to displace the diaphragm;

a drive voltage generator to generate a discharge pulse voltage to drive the piezoelectric element to discharge liquid droplets from the nozzles;

a micro-drive voltage generator to generate a micro-driving pulse voltage to drive the piezoelectric element to vibrate a meniscus formed on the nozzle, the micro-driving pulse voltage being smaller than the discharge pulse voltage so that the micro-driving pulse voltage does not drive the piezoelectric element to discharge liquid droplets from the nozzles;

a voltage applier to apply a voltage waveform including a discharge pulse voltage and a micro-driving pulse voltage to the piezoelectric element; and a nozzle activation ratio processor to calculate a nozzle activation ratio of the nozzles based on drive data for discharging liquid droplets from the nozzle, wherein:

the micro-drive voltage generator generates a micro-driving pulse voltage, a peak voltage of which corresponds to the nozzle activation ratio calculated by the nozzle activation ratio processor, and the voltage applier applies the voltage waveform including the micro-driving pulse voltage generated by the micro-drive voltage generator and the discharge pulse voltage generated by the drive voltage generator to the piezoelectric element, and wherein:

the micro-drive voltage generator generates a plurality of micro-driving pulse voltage, the peak voltage of which are different based the nozzle activation ratio calculated by the nozzle activation ratio processor, the micro-drive voltage generator generates a first micro-driving pulse voltage and the voltage applier applies the voltage waveform including the first micro-driving pulse voltage to the piezoelectric element when the nozzle activation ratio calculated by the nozzle activation processor exceeds a threshold value; and the micro-drive voltage generator generates a second micro-driving pulse voltage, the peak voltage of which is smaller than that of the first micro-driving pulse voltage and the voltage applier applies the voltage waveform including the second micro-driving pulse voltage to the piezoelectric element when the nozzle activation ratio is below the threshold value.

2. The liquid droplet discharge head as claimed in claim 1, wherein:

the micro-drive voltage generator generates the first micro-driving pulse voltage when the image data includes any data other than text, and the micro-drive voltage generator generates the second micro-driving pulse voltage when the image data includes only text.

3. An image forming apparatus comprising, a liquid droplet discharge head as claimed in claim 1 for forming an image on a recording medium by discharging a recording liquid from the nozzle.

4. An image forming apparatus comprising a liquid droplet discharge head for forming an image on a recording medium by discharging a recording liquid, the liquid droplet discharge head comprising:

a liquid chamber to which a liquid is supplied;

a plurality of nozzles from which the liquid is discharged;

a diaphragm to change a pressure inside the liquid chamber;

a piezoelectric element to displace the diaphragm;

a drive voltage generator to generate a discharge pulse voltage to drive the piezoelectric element to discharge liquid droplets from the nozzles;

a micro-drive voltage generator to generate a micro-driving pulse voltage to drive the piezoelectric element to vibrate a meniscus formed on the nozzle, the micro-driving pulse voltage being smaller than the discharge pulse voltage so that the micro-driving pulse voltage does not drive the piezoelectric element to discharge liquid droplets from the nozzles;

a voltage applier to apply a voltage waveform including a discharge pulse voltage and a micro-driving pulse voltage to the piezoelectric element; and a nozzle activation ratio processor to calculate a nozzle activation ratio of the nozzles based on drive data for discharging liquid droplets from the nozzle, wherein:

the micro-drive voltage generator generates a micro-driving pulse voltage, a peak voltage of which corresponds to the nozzle activation ratio calculated by the nozzle activation ratio processor, and the voltage applier applies the voltage waveform including the micro-driving pulse voltage generated by the micro-drive voltage generator and the discharge pulse voltage generated by the drive voltage generator to the piezoelectric element, and wherein:

the micro-drive voltage generator generates a plurality of micro-driving pulse voltage, the peak voltage of which are different based the nozzle activation ratio calculated by the nozzle activation ratio processor, the micro-drive voltage generator generates a first micro-driving pulse voltage and the voltage applier applies the voltage waveform including the first micro-driving pulse voltage to the piezoelectric element when the nozzle activation ratio calculated by the nozzle activation processor exceeds a threshold value, and the micro-drive voltage generator generates a second micro-driving pulse voltage, the peak voltage of which is smaller than that of the first micro-driving pulse voltage and the voltage applier applies the voltage waveform including the second micro-driving pulse voltage to the piezoelectric element when the nozzle activation ratio is below the threshold value.

5. The image forming apparatus as claimed in claim 4, wherein:

the micro-drive voltage generator generates the first micro-driving pulse voltage when the image data includes any data other than text, and the micro-drive voltage generator generates the second micro-driving pulse voltage when the image data includes only text.

* * * * *